US006324939B1

(12) United States Patent
Cicotte

(10) Patent No.: US 6,324,939 B1
(45) Date of Patent: Dec. 4, 2001

(54) ADJUSTABLE AUTOMOBILE PEDAL SYSTEM

(76) Inventor: Edmond B. Cicotte, 11086 Hedgeway, Utica, MI (US) 48317

( * ) Notice: Subject to any disclaimer, the term of this patent is extended or adjusted under 35 U.S.C. 154(b) by 0 days.

(21) Appl. No.: 09/250,476

(22) Filed: Feb. 14, 1999

(51) Int. Cl.[7] ..... G05G 1/14
(52) U.S. Cl. ..... 74/512
(58) Field of Search ..... 74/512, 513, 560

(56) References Cited

U.S. PATENT DOCUMENTS

| | | | | |
|---|---|---|---|---|
| 3,151,499 | * | 10/1964 | Roe | 74/560 |
| 3,282,125 | * | 11/1966 | Dully | 74/512 X |
| 3,563,111 | * | 2/1971 | Zeigler | 74/512 |
| 4,870,871 | * | 10/1989 | Ivan | 74/512 X |
| 5,172,606 | * | 12/1992 | Dzioba et al. | 74/512 |
| 5,351,573 | | 10/1994 | Cicotte . | |
| 5,460,061 | | 10/1995 | Redding et al. . | |
| 5,632,183 | | 5/1997 | Rixon et al. . | |
| 5,697,260 | | 12/1997 | Rixon et al. . | |
| 5,722,302 | | 3/1998 | Rixon et al. . | |
| 5,771,752 | | 6/1998 | Cicotte . | |
| 5,819,593 | | 10/1998 | Rixon et al. . | |
| 5,823,064 | | 10/1998 | Cicotte . | |

* cited by examiner

*Primary Examiner*—Mary Ann Green
(74) *Attorney, Agent, or Firm*—Vanophem & Vanophem, P.C.

(57) ABSTRACT

A pedal adjustment system for an automobile having an accelerator cable and a master cylinder pushrod with a free end, the system having a brake pedal secured to a lower end of a brake pedal arm and an accelerator pedal secured to a lower end of an accelerator pedal arm. The adjustment of the brake pedal arm is effected by pivoting about the free end of the master cylinder pushrod, which pivotally engages the brake pedal arm between its ends, the pivoting being done by imposing a reversible force from an electric motor and gearbox assembly attached to an upper end of the brake pedal arm. The accelerator pedal arm, an upper end of which engages the accelerator cable, is adjusted in unison with the brake pedal arm by providing an accelerator pedal adjustment link, an upper end of which is coaxial with the brake pedal arm and a lower end of which is pivotally attached to the accelerator pedal arm at a location between the upper and lower ends of the accelerator pedal arm.

14 Claims, 4 Drawing Sheets

ADJUSTABLE AUTOMOBILE PEDAL SYSTEM

BACKGROUND OF THE INVENTION

1. Field of the Invention

The present invention generally relates to automobile control pedals, such as brake, clutch and accelerator pedals. More specifically, this invention relates to an adjustable automobile control pedal system whose pedals can be selectively adjusted to allow optimal positioning of the pedals relative to the driver of the automobile.

2. Description of the Prior Art

Automobiles are conventionally provided with foot-operated control pedals, such as an accelerator, brake and clutch pedal that are used in the control of motion and speed of the automobile. Typically, these control pedals are permanently fixed to the vehicle body and rotate or pivot away from the driver when foot pressure is applied, and are not adjustable relative to the driver or their respective attachment points. Consequently, the control pedals must generally be attached so as to be positioned relative to the driver of the vehicle to afford operation that is adequately safe and comfortable for the "average" driver. However, some adjustment of the driver's position relative to the control pedals is clearly desirable since the vehicle and its controls must accommodate drivers of various physical attributes.

Though the driver's seat is usually mounted so as to be slidable in a fore and aft and up and down direction to accommodate drivers of different physiques, such an arrangement is only partially effective in positioning the driver relative to the control pedals. Seat adjustment allows the driver to position himself or herself relative to the automobile's steering wheel and the control pedals, to some degree improving the driver's comfort and facilitating the driver's ability to operate the vehicle's primary controls. It is, however, nearly impossible for such a solution to accommodate all possible variations in the human frame. In particular, proportional differences between the lengths of a driver's arms, legs and feet in relation to the driver's overall physique cannot be readily accommodated by merely adjusting the seat fore and aft or up and down with respect to the control pedals. Accordingly, it has been recognized that some form of control pedal adjustment is desirable to provide optimal comfort and safety to the driver while also ensuring that the driver can fully operate the control pedals at all times.

Lever mechanisms, of course, are known in the prior art. The adjustment of one lever with respect to another concentrically mounted lever can also be found in wear or slack adjuster mechanisms. For example, Tack et al., U.S. Pat. No. 2,550,731, and Tack et al., U.S. Pat. No. 2,550,732, teach a manually operated screw mechanism threaded into one lever and operatively connected to associated hangers for adjusting the slack conditions in the brake rigging by adjustment with respect to the hangers and simultaneously modifying the position of the brake lever where it is connected to the associated brake rigging to allow for further wear adjustment.

Many approaches to providing adjustable control pedals have been suggested in the prior art. One approach is to provide some form of ratchet device that allows the entire control pedal assembly to rotate about a primary pivot point. This approach rotates a housing to which the control pedals are each rotatably attached, thus providing rotation of the control pedals in unison relative to the driver. Examples of this approach are illustrated in U.S. Pat. No. 3,282,125 to Dully, U.S. Pat. No. 3,400,607 to Smith, and U.S. Pat. No. 3,563,111 to Zeigler. A similar approach is to mount one or more control pedals to a housing, attached to the body of the vehicle, which is slidable fore and aft as a unit relative to the driver, as illustrated in U.S. Pat. No. 2,860,720 to Huff et al., U.S. Pat. No. 4,683,977 to Salmon, U.S. Pat. No. 5,010,782 to Asano et al., and British Patent No. 952,831 to Mussell. As taught by Asano et al., the entire housing and pedal assembly rotates about a single pivot point during actuation of the pedals. A disadvantage with pedal systems such as that of Asano et al. is that a spring is required to return the pedal and housing assembly to its initial position, necessitating that the driver also overcome the force generated by the spring in order to actuate the pedal, resulting in an increase of brake pedal effort.

Another suggested approach is a variation on the two previously mentioned, employing a screw-actuated device to displace a housing to which one or more control pedals are rotatably mounted. The screw-actuated device can be used to either rotate the entire housing about a pivot point, as shown in U.S. Pat. No. 3,151,499 to Roe, or the screw-actuated device can displace the housing fore and aft, as illustrated by U.S. Pat. No. 3,301,088 to White; U.S. Pat. No. 3,643,525 to Gibas; U.S. Pat. No. 3,765,264 to Bruhn, Jr.; U.S. Pat. No. 4,870,871 to Ivan; U.S. Pat. No. 4,875,385 to Sitrin; U.S. Pat. Nos. 4,989,474 and 5,078,024 to Cicotte et al.; and U.S. Pat. No. 5,460,061 to Redding, et al. Typically, the screw-actuated device is disclosed to be driven by an electric motor, which allows the control pedals to be selectively adjusted by the driver from an appropriate actuator switch mounted on the dashboard of the vehicle within the driver's reach.

A further attempt to provide a solution for this problem is disclosed by Rixon et al. in U.S. Pat. No. 5,632,183, wherein a pedal assembly is mounted on a single hollow guide rod extending forwardly from a transmission housing that is pivotably mounted to a bracket secured to a body portion of the vehicle. A helical ball and nut assembly is positioned within the single hollow guide and extends from the transmission housing. A key extends from the nut to the pedal assembly that is mounted to the outside diameter of the single hollow guide so that linear movement of the nut along the helical thread within the hollow guide generates linear movement in forward or rearward directions of the pedal assembly along the hollow guide rod.

As can be readily appreciated by those skilled in the art, the above examples all require substantial hardware and space beneath the automobile's instrument panel to accommodate the device and its associated structure providing the adjustment features. Much of the necessary additional hardware can be attributed to the need to avoid affecting the operation of the brake and/or clutch pedals, during adjustment, with their respective power sources. Specifically, the approach chosen must avoid causing the brake pushrod and accelerator cable attachment points that actuate the respective brake and accelerator components to be displaced relative to their designed positions so as to ensure operation within the correct operational characteristics of the brakes, clutch, and/or accelerator pedals.

In addition, it is generally preferable that the approach chosen have no effect on the mechanical advantage of the brake control pedal as determined by the brake control pedal's orientation relative to the brake pushrod. Generally, the mechanical advantage of a control pedal can be described as the relative effort required to apply the brake pedal as compared to the actual force required to actuate the adjustment device associated with the brake pedal. For instance, mechanical advantage can be increased by moving the contact point between the brake pedal and the brake cylinder's pushrod toward the pivot point of the brake pedal.

To avoid changing the mechanical advantage, the adjustable control pedal assemblies of the prior art generally teach a device in which the control pedals are independently adjusted so as to produce no adverse effect with respect to repositioning of the pedal pivot point relative to the pushrods of the respective operating cylinders, as can be seen with the teachings of Cicotte et al. in U.S. Pat. Nos. 5,351,573, 5,771,752 and 5,823,064. Alternatively, the adjustment device must be provided with a mechanism that simultaneously adjusts the length of the pushrod to accommodate the displacement of the control pedal assembly, as seen with the teachings of Bruhn, Jr.

Though regarding an unrelated and non-analogous problem associated with optimizing the mechanical advantage of a control pedal, U.s. Pat. No. 3,798,995 to Schroter teaches the use of a variable-ratio control pedal utilizing a camming contour for amplifying the mechanical advantage of the control pedal in the latter stages of the control pedal stroke. The intent with such a device is to maximize the driver's braking effort without the need for excessive forces applied to the control pedal. However, the teachings of Schroter are directed entirely toward achieving an optimal mechanical advantage and do not provide any adjustment of the control pedals with respect to the position of the driver. Further, Schroter does not teach or suggest a solution to the problem of adjusting the positions of the control pedals, nor does Schroter even recognize the problem to which the above prior art is directed.

From the above discussion, with the exception of the recent Cicotte patents, it can be readily appreciated that the prior art does not disclose an automobile control pedal arrangement that can be adjusted to adapt to the particular physiological requirements of a driver, while simultaneously avoiding the requirement of mounting the entire control pedal assembly to a housing that is either pivotable or displaceable relative to the position of the driver, without affecting the brake effort, however small. Nor does the prior art teach or suggest an apparatus that entails minimal additional hardware to achieve suitable adjustment of one or more control or accelerator pedals to the effect that no repositioning of the prior art pivot point locations is required and, therefore, no significant structural changes need be made to a conventional control pedal arrangement.

Although, generally, repositioning of an attachment or pivot point is unacceptable because of its effect on brake/accelerator/clutch pedal forces or efforts, the specifications for angular variations are more generous because small angular variations with respect to current pivot point locations have little or no effect on the operational parameters, i.e., brake/clutch effort.

Accordingly, what is needed is a cost-efficient adjustment device for adjusting one or more automobile brake/clutch control and/or accelerator pedals, as well as footrests. The adjustment device is capable of spatially adjusting the control pedals without repositioning the pivot attachment of the conventional control pedal arrangement to adapt to the physical and physiological demands of a driver, and is simultaneously cost effective by requiring minimal structural components and modifications to achieve the desired functional and safety results.

SUMMARY OF THE INVENTION

According to the present invention there is provided an adjustment device for one or more automobile control and/or accelerator pedals and/or footrest. The adjustment device is capable of causing pivotable adjustment, utilizing with very slight variation the conventional pivot point position of the control pedals to adjust one or more control pedals independently or in unison relative to a predetermined datum point. The datum point is preferably defined by a reaction member upon which the control pedal operates, such as the pivot eyelet of a master cylinder pushrod for a clutch or brake pedal, due to the requirement that no force be exerted on the accelerator/clutch or brake master cylinder during adjustment of the respective control pedals. For an accelerator pedal, the reaction member is typically a flexible cable by which the air/fuel supply delivery system is operated. Because the accelerator pedal is typically pivotally mounted to the floor pan of a vehicle for purposes of actuating the cable, the datum point may be any suitable, currently established reference point that allows conventional operation of the accelerator pedal with respect to the cable. Being adjustably pivotable in this manner, the control pedals can be optimally positioned to accommodate prior art routings for the accelerator cable and brake pushrod, as well as to suit the needs of a particular driver.

Conventionally, each control pedal includes a pedal arm that is pivotally attached to a housing bracket beneath the instrument panel of the automobile by means of a pivot pin and bushing or the like. Where the control pedal is the brake or clutch pedal, the adjustment device of the present invention is mounted alongside the conventional control pedal arm and pivotally attached at the eyelet of the master cylinder pushrod, in turn providing an attachment pivot about which the pedal arm pivots during adjustment, while maintaining a predetermined relationship between the pushrod eyelet and the pivot attachment of the control pedal arm. Consequently, the adjustment device can be readily adapted to fit conventional control pedal assemblies without any modification of the fore/aft position of the pushrod eyelet. Some limited angular displacement (within specified tolerances) with respect to the exit point in the front dash is permitted.

According to the preferred embodiment of the present invention, the pushrod of the brake master cylinder is pivotally mounted to the brake pedal arm at a location between the uppermost and lowermost ends of the brake pedal arm. Pivoting of the brake pedal arm is accomplished by actuation of an electric motor and gearbox assembly, that is mounted at a fixed location on a mounting bracket and acts on a transversely extending pivot shaft mounted within opposing straight slots in the mounting bracket to which the brake pedal arm is pivotally secured at a location near the uppermost end of the brake pedal arm. The pivot shaft is oscillatable within the opposing straight slots of the fixed mounting bracket and the brake pedal is caused to move toward or away from the driver by the actuation of the electric motor and gearbox assembly whose output shaft is externally threaded and is received in an internally threaded opening of a pivotable clevis housing mounted to the pivot shaft. The pivot shaft also carries an accelerator pedal adjustment link arm, which is attached to the accelerator pedal arm, to slave the accelerator pedal to the brake pedal so that in the preferred embodiment as the brake pedal is moved toward or away from the seated position of the driver by the operation of the electric motor and gearbox assembly, the accelerator pedal will similarly be moved toward or away from the driver by an equivalent amount. Those skilled in the prior art will quickly recognize that each pedal can be independently controlled by its own adjustable mechanism so as to enable different pedal adjustments to individual pedals, if desired. Because of the modular assembly of the accelerator pedal and brake pedal being attached to the same mounting bracket, the preferred embodiment of the present invention eliminates the need for the use of cables between the accelerator pedal adjuster mechanism and brake pedal adjuster mechanism of the various embodiments of the invention described in the aforesaid disclosed prior art.

Accordingly, it is an object of the present invention to provide an adjustable pedal system for adjusting the positions of one or more automobile control pedals that is capable of optimally positioning the control pedals relative to the driver without affecting the current positions of the pivot point of the brake pedal arm.

It is a further object of the present invention to provide an automobile pedal system of the foregoing character that is capable of adjusting the positions of automobile control pedals relative to a predetermined fixed datum, such as the pushrod eyelet of the hydraulic cylinder that is operated by the brake pedal.

It is still a further object of the present invention to provide an automobile pedal system of the foregoing character that eliminates the need for wire cables between the brake and accelerator pedal mechanisms that are characteristic of some prior adjustable pedal systems.

It is another object of the present invention to provide an adjustable brake/clutch/accelerator/footrest pedal that utilizes a compact electric motor, gearbox and actuator shaft assembly with limited movement during operation thereof and is economical and easy to manufacture.

It is yet another object of the present invention to provide a modular assembly of an adjustable brake/clutch/accelerator/footrest pedal adjustment device that reduces the number of components, reduces the cost of assembly, and is intended to drop in place on a current production vehicle.

It is still a further object of the present invention to provide a brake/clutch/accelerator/footrest adjustable pedal assembly that utilizes a single mounting bracket to mount all adjustable components of an accelerator brake or clutch pedal.

For a further understanding of the present invention and the objects thereof, attention is directed to the drawings and the following brief description thereof, to the detailed description of the preferred embodiment and to the appended claims.

DETAILED DESCRIPTION OF THE PREFERRED EMBODIMENT

Figure 2:
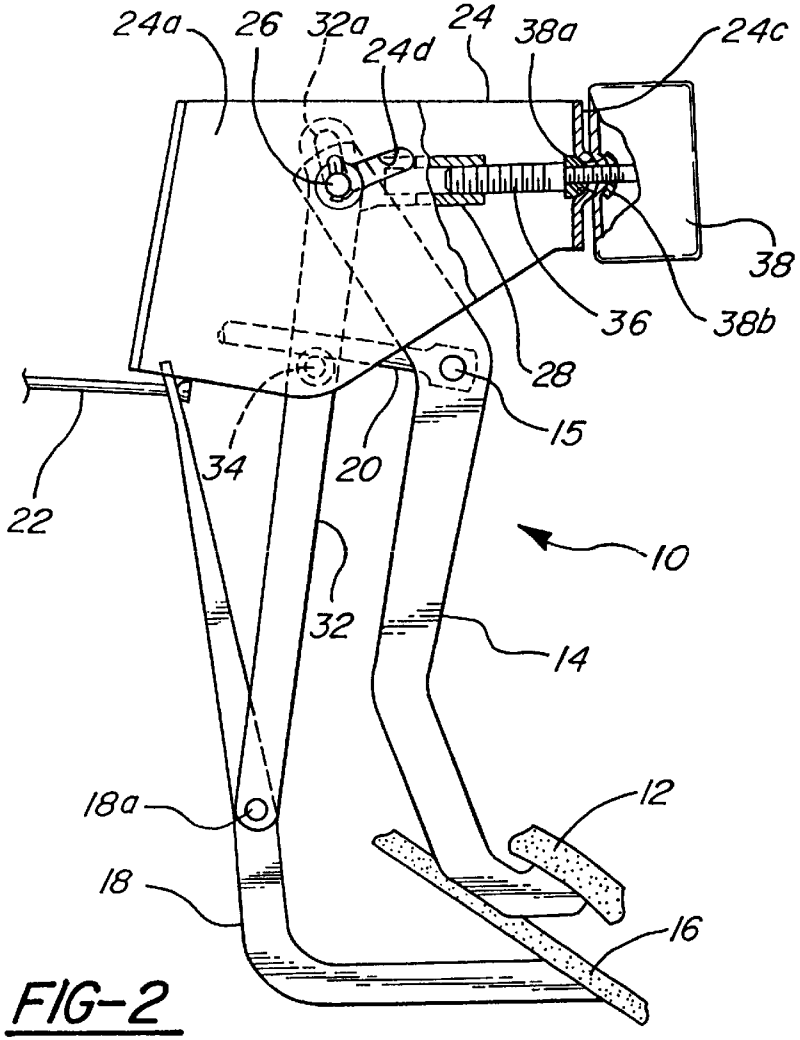
FIG. 2 is a view similar to FIG. 1 in the most rearward position (closest to the driver) of the adjustable pedals shown therein.

With reference to FIGS. 1–4, there is shown an adjustable automobile pedal system according to the preferred embodiment of the present invention; the adjustable pedal system is indicated generally by reference number 10. The adjustable pedal system 10 includes a brake pedal 12, that is positioned at the lowermost end of a brake pedal arm 14, and an accelerator pedal 16, that is positioned at the lowermost end of an accelerator pedal arm 18. As is clear from a comparison of FIGS. 1 and 2, that illustrates the total travel adjustment positions of the brake pedal 12 and the accelerator pedal 16, that is, the adjusted end of travel (FIG. 2) and beginning of travel (FIG. 1) positions the pedals will occupy when the pedals are not being engaged by a foot of an operator, the brake pedal 12 and the accelerator pedal 16 are capable of being moved toward or away from the operator in unison, between limits, as will be hereinafter described more fully.

The brake pedal arm 14 is pivotably attached at 15 and acts on a pushrod 20 of a brake master cylinder, otherwise not shown. The pushrod 20 pivotally engages the brake pedal arm 14 at a location between the uppermost and lowermost ends of the brake pedal arm 14, the selected engaging point being so as to not affect the brake effort in any way whatsoever from the designed brake effort for the specific vehicle. Thus, when an operator depresses the brake pedal 12, the brake pedal arm 14 will push the pushrod 20 into the booster and associated brake master cylinder to impart a braking force to the vehicle in which the pedal system 10 is installed. Similarly, the accelerator pedal arm 18 engages an accelerator cable 22, the accelerator cable 22 being engaged by the accelerator pedal arm 18 at a location near the uppermost end of the accelerator pedal arm 18. Thus, when an operator depresses the accelerator pedal 16, the accelerator pedal arm 18 will pull the accelerator cable 22 to impart an accelerating action to the vehicle in which the pedal system 10 is installed as is well understood by a person skilled in the prior art.

Figure 1:
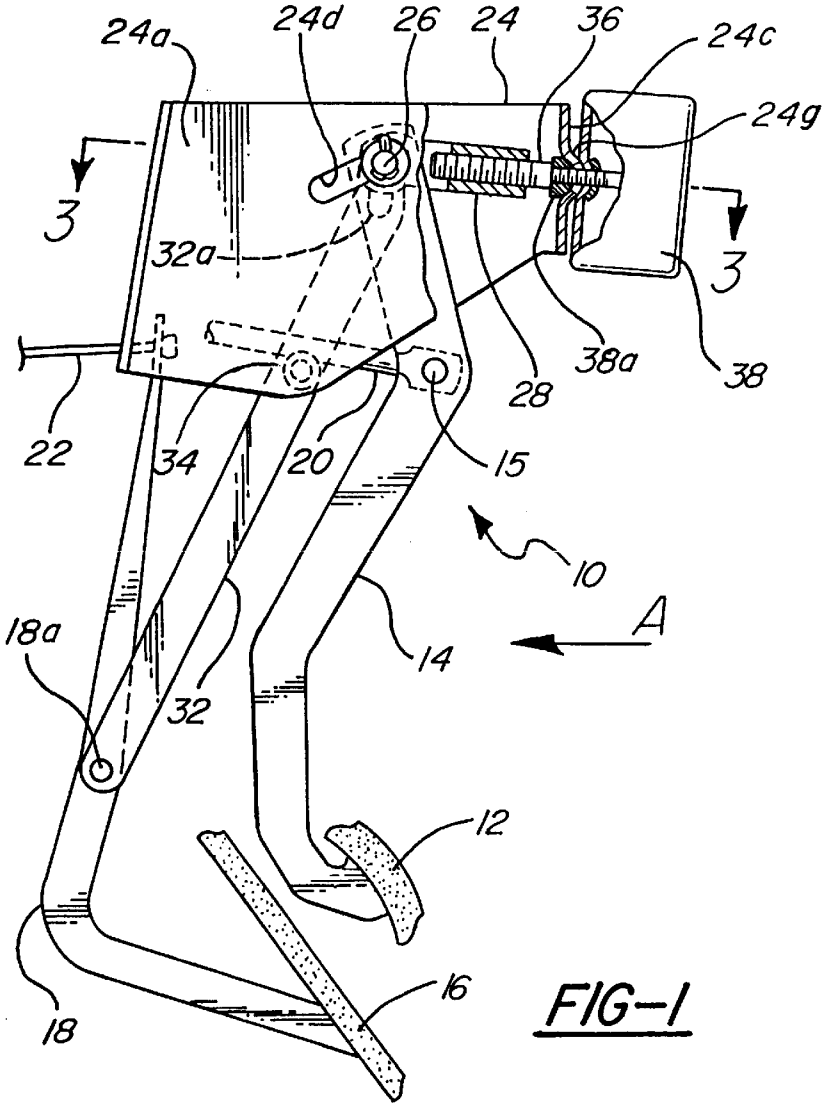
FIG. 1 is an elevational side view of the brake and accelerator pedals and related position adjustment elements of an adjustable automobile pedal system according to the preferred embodiment of the present invention in the most forward position (away from the driver) of the adjustable pedals shown therein.
Figure 3:
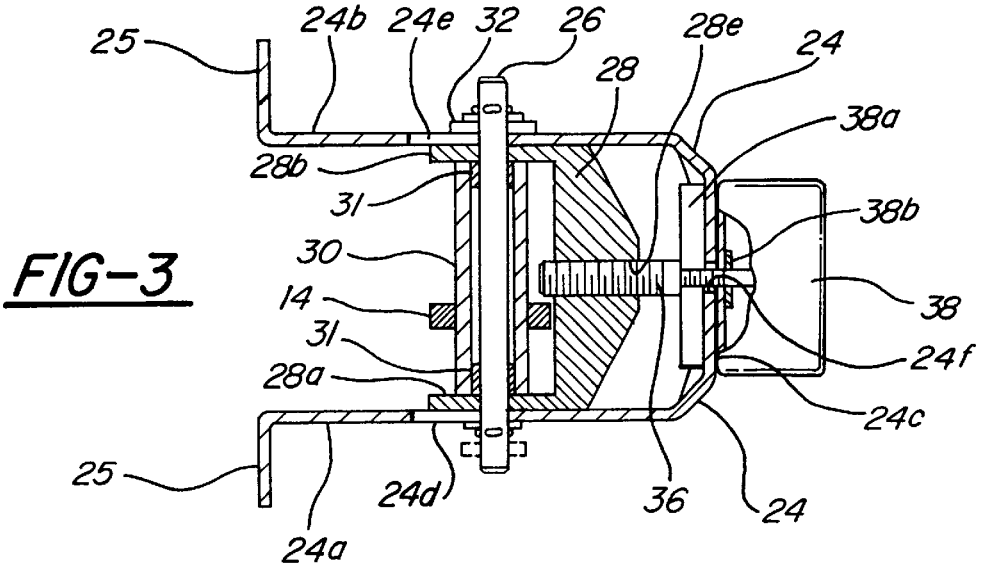
FIG. 3 is a sectional view taken on line 3—3 of FIG. 1.

Adjustment between the fore and aft positions of the brake pedal 12 and the accelerator pedal 16 involves the use of a generally "U" shaped bracket 24, having a flange 25 at the open end, that can be mounted under the dashboard in a fixed position under the instrument panel of an automobile, otherwise not shown, it being understood that the dashboard of the automobile is positioned to the left of the bracket 24 in the orientation of the bracket 24 shown in FIGS. 1 and 2. As is clear from FIG. 3, the bracket 24 has a spaced apart pair of legs 24*a* and 24*b* and is closed at one end by a transverse end 24*c*, the opposed end of the bracket 24 being open.

The legs 24*a* and 24*b* of the bracket 24 are provided with straight slots 24*d* and 24*e* respectively, and a pivot shaft 26 extends transversely of the bracket 24, through the slots 24*d* and 24*e*. Mounted to the portion of the pivot shaft 26 that is within the legs 24*a* and 24*b* of the bracket 24 is a pivotable clevis housing 28, that oscillates with the pivot shaft 26 as the pivot shaft 26 moves from a foremost to a rearmost position within the slots 24*d* and 24*e* of the bracket 24, as hereinafter described more fully. The clevis housing 28 has a sleeve 30 extending between opposed legs 28*a* and 28*b* of the clevis housing 28, and the sleeve 30 circumscribes that portion of the pivot shaft 26 between the opposing legs 28*a* and 28*b* with appropriate bearings 31 therebetween so as to oscillate with the pivot shaft 26 as the pivot shaft 26 moves from one extreme end to the opposite extreme end of the slots 24*d* and 24*e* of the bracket 24.

The oscillating movement of the pivot shaft 26 within the slots 24*d* and 24*e* of the bracket 24, as heretofore described, causes the sleeve 30 to oscillate with the pivot shaft 26. The oscillation of the sleeve 30, in turn, will cause the brake pedal arm 14 to pivot about the free end of the pushrod 20 because the brake pedal arm 14 is pivotally attached to the sleeve 30 at a location near its uppermost end to the sleeve 30, as is shown most clearly in FIG. 3. The pivoting of the brake pedal arm 14, in turn, is imparted to the accelerator pedal arm 18 by an accelerator pedal adjustment link 32 as more clearly shown in FIG. 4. An uppermost end of the adjustment link 32 is offset and pivotally attached to the pivot shaft 26 at a location external to the leg 24*b* of the "U" shaped bracket 24.

The link 32 has a longitudinal slot 32*a* at the uppermost end to receive the pivot shaft 26 therethrough. The link 32 is also attached with a fixed pivot 34 to one leg 24*b* of the housing bracket 24. A lower end of the accelerator pedal adjustment link 32 is pivotally attached (shown at 18*a*) to the accelerator pedal arm 18 at a location between the uppermost end and the lowermost end of the accelerator pedal arm 18. Operation of the accelerator pedal arm 18 by an operator, thus, results in pivoting of the accelerator pedal arm 18 about the location of its attachment point 18*a* to the lowermost end of the accelerator pedal adjustment link 32 in a similar manner so as to "pull" on the accelerator cable 22. In a similar manner, the operation of the brake pedal arm 14 by an operator results in pivoting of the brake pedal arm 14 about the location of its attachment to the sleeve 30 that surrounds the pivot shaft 26 and imparts a brake force on the master cylinder connecting rod at its attachment point 15 to actuate the brake. Thus, the brake pedal arm 14 functions as a first class lever and the accelerator pedal arm 18 functions as a second class lever.

Fore and aft adjustment of the brake and accelerator pedal arms 14 and 18 is accomplished by the use of a helical screw 36 that has one end threaded into a helical threaded aperture 28*e* in the pivotable clevis housing 28. The opposite end of the helical screw 36 is attached to a gearbox and electric motor assembly 38 mounted to the closed transverse end 24*c* of the "U" shaped bracket 24. An aperture 24*f* in a spherical dimple 24*g* in the closed transverse end 24*c* of the "U" shaped bracket 24 allows the helical screw 36 to pass therethrough and be fastened to the electric motor drive shaft in any conventional way. The gearbox and electric motor assembly 38 is attached to the closed transverse end 24*c* of the bracket 24 by a lock nut 38*a* located within the "U" shaped bracket 24 and mounted to a threaded sleeve located within the aperture, and a second lock nut 38*b* having a spherical end surface complementary to the spherical dimple 24*g* in the transverse end 24*c* of the "U" shaped bracket. This arrangement permits the electric motor to be locked in place against the spherical dimple and pivot about the spherical dimple 24*g* as will be clearly understood from an operational description that follows.

In operation when it is desired to adjust the accelerator and brake pedal from their most forward position shown in FIG. 1 to a position closer to the driver of the vehicle, the electric motor is energized to drive the gear box that turns the helical screw 36. As the helical screw 36 begins to rotate, the pivotable clevis housing 28 is moved in a linear direction away from the closed transverse end 24*c* of the bracket 24. Since the opposing walls of the clevis housing 28 are mounted on the pivot shaft 26, the pivot shaft 26 is moved along the straight lines of the slots 24*d* and 24*e*. Simultaneously the brake pedal is pivoted about its pivot attachment point 15 to move the brake pedal 12 rearwards or forwards to the driver seated in the vehicle. Since the preferred embodiment illustrates a modular unit, the accelerator pedal will simultaneously be moved rearwards about its fixed pivot attachment point 34 towards the feet of the driver of the vehicle. The limit of adjustment is reached when the pivot shaft 26 reaches the end of the straight slots 24*d* and 24*e*. It is expected that an electrical switch (not shown) will be conveniently mounted within the reach of the driver of the vehicle to activate/deactivate the gearbox and electric motor assembly of the adjuster mechanism of the preferred embodiment. With the modular unit described in the preferred embodiment the positional relationship established between the brake, accelerator/clutch pedals will be maintained throughout the completed cycle of the total available adjustment of the pedal system. Therefore all three pedals, including the clutch, if applicable, will move together in a rearward direction closer to the feet of the driver. If individual pedal adjustment is desired, it is foreseeable that individual adjustable mechanisms may be provided for each pedal according to the disclosed invention to provide individual pedal adjustment, as desired.

Figure 4:
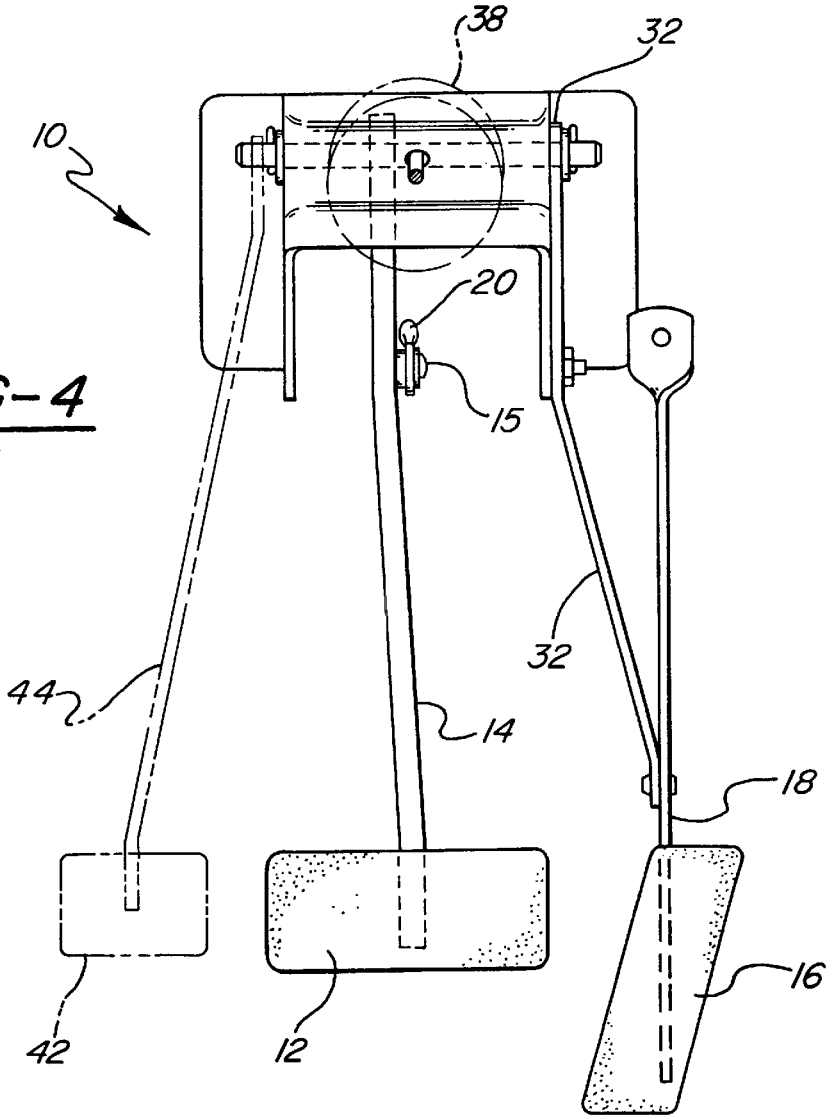
FIG. 4 is an elevational view taken in the direct of arrow A of FIG. 1 including the clutch pedal, clutch pedal arm and motor shown in phantom.

The pedal system 10, as heretofore described, involves only a pair of pedals, namely the brake pedal 12 and the accelerator pedal 16, and, as such, is suitable for use in an automobile with an automatic transmission. If desired, however, the pedal system 10 can be adapted for use in automobiles with manual transmissions, in which case the pedal system must also function to adjust the position of a clutch pedal while adjusting the positions of the brake and accelerator pedals. Such an arrangement is illustrated in FIG. 4, where a clutch pedal 42 is shown as being attached to the lowermost end of a clutch pedal arm 44, both of which are shown in broken line. An uppermost end of the clutch pedal arm 44, in turn, is pivotally attached to the pivot shaft 26 at a location external to the leg 24*a* of the bracket 24.

Figure 5:
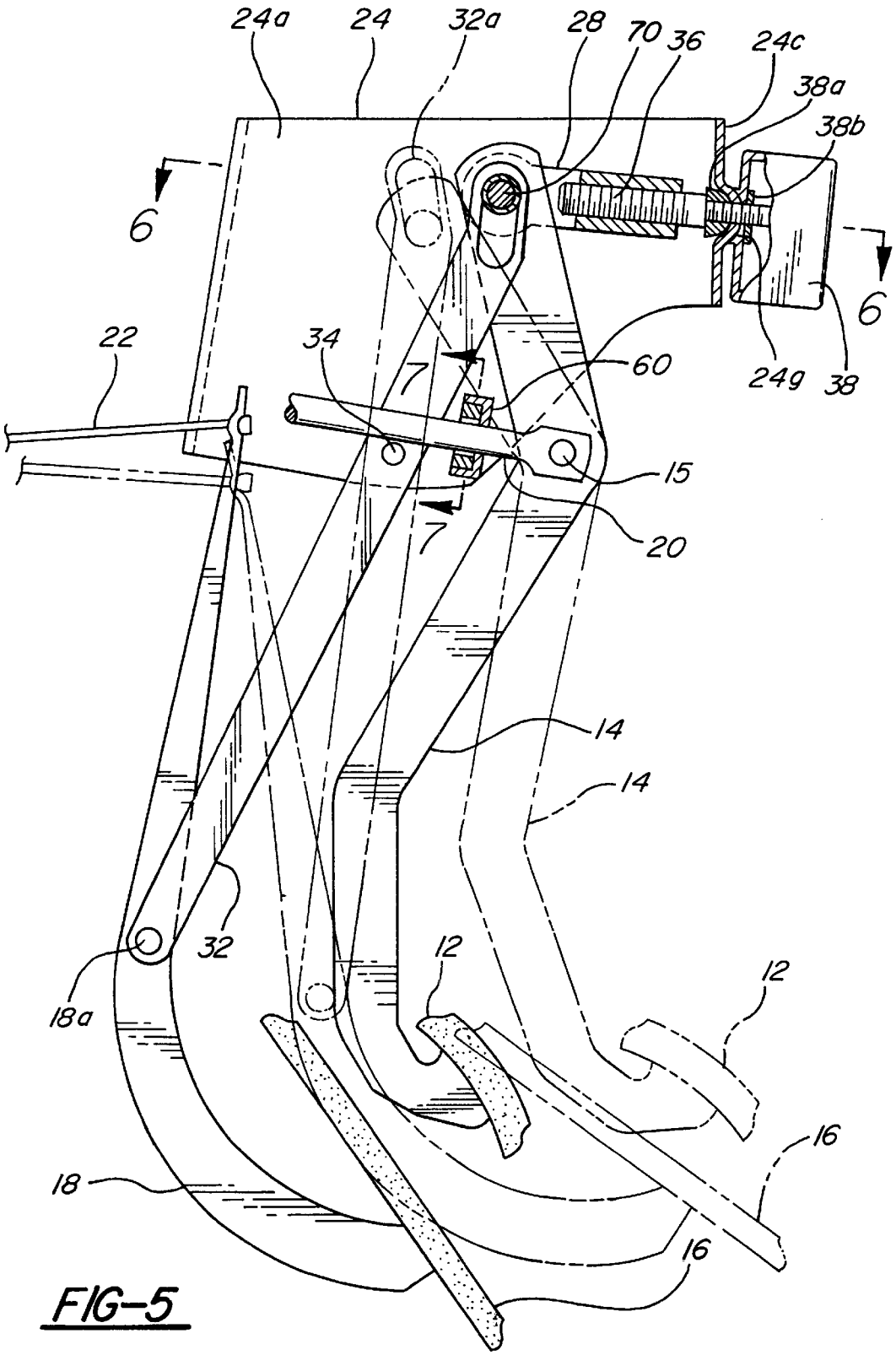
FIG. 5 is an elevational side view of an alternate embodiment of the present invention.
Figure 6:
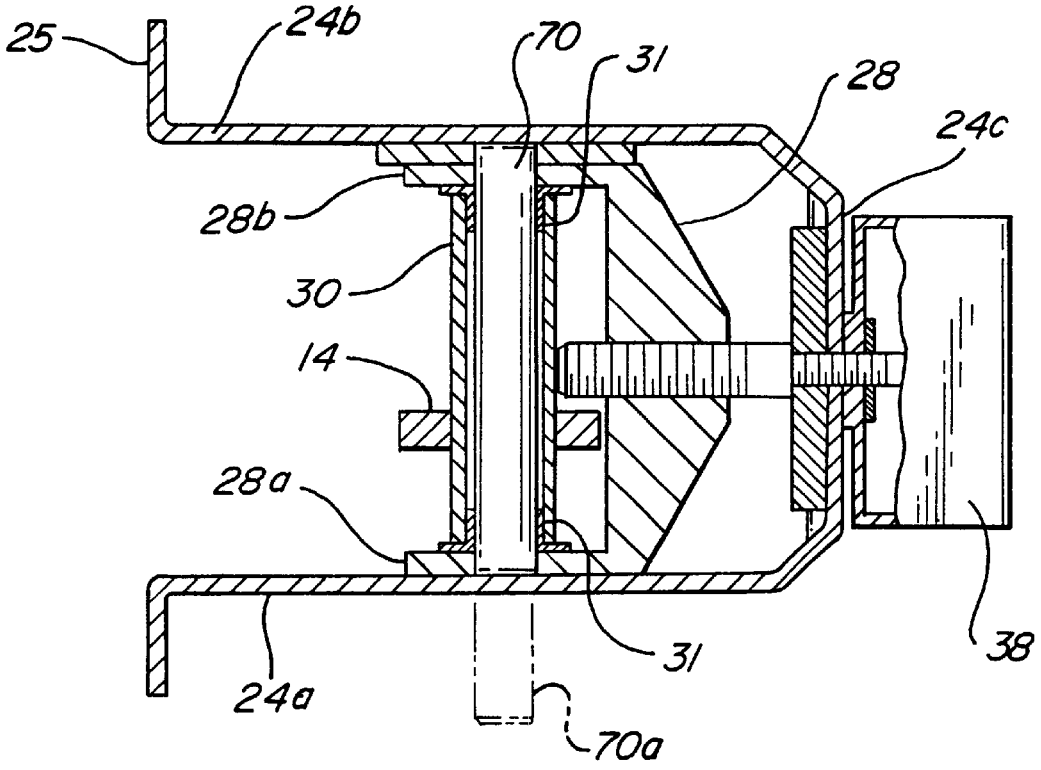
FIG. 6 is a sectional view taken along line 6—6 of FIG. 5.
Figure 7:
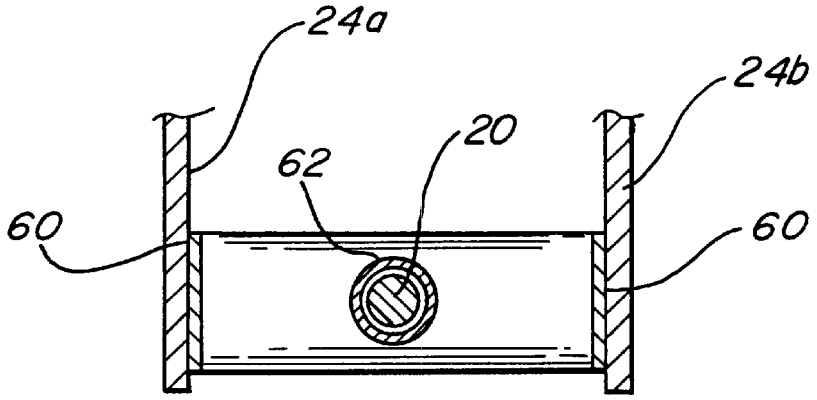
FIG. 7 is a cross-sectional view taken along line 7—7 of FIG. 5.

FIGS. 5–7 represent an adjustable pedal assembly in accordance with an alternate embodiment of this invention. The same reference numerals are used to represent identical or similar components of the preferred embodiment of FIGS. 1–4. However, this embodiment utilizes a pushrod support mounting bracket 60 fixed between the two legs 24*a* and 24*b* of the "U" shaped bracket so that a pivot shaft 70 is confined completely between the two legs 24*a* and 24*b* of the "U" shaped bracket 24. The pushrod support mounting bracket 60 carries a pushrod support bearing 62 in which the pushrod is securely mounted. By providing support of the pushrod 20 with the pushrod support mounting bracket 60 the pivotable clevis housing 28 and associated pivot shaft 70 is guided during its adjustment stroke by the opposing legs 28*a* and 28*b* sliding between the opposing legs 24*a* and 24*b* of the "U" shaped bracket. The uppermost portion of the accelerator pedal adjustment link 32 has been mounted to the pivot shaft 70 between the opposing legs 24*a* and 24*b* as shown in FIG. 5 instead of outside of the leg 24*b* of FIG. 3, to enable the use of a shortened pivot shaft 70 and thereby eliminate the need for any slots in the legs 24*a* and 24*b* of the "U" shaped bracket 24.

If it was required that the modular adjustable pedal system described in the embodiment of FIGS. 5–7 also adjust a clutch pedal, it would simply be mounted to an extended pivot shaft 70*a* outside of the "U" shaped bracket 24 so as to provide adjustment to the clutch simultaneous with the brake and accelerator pedals.

In operation, the alternate embodiment of FIGS. 5–7 operates the same as the preferred embodiment of FIGS. 1–4 except that since there are no slots in the legs 24*a* and 24*b* of the "U" shaped bracket 24, the legs 24*a* and 24*b* themselves become a guide for the pivotable clevis housing 28 to oscillate therewithin as the adjustment screw is driven by the gear box/motor assembly from a fully rearward position (pedals in the most forward position) to a fully extended position (pedals in the most rearward position) closer to the driver. The pivot attachment with the pushrod securely supported within the pushrod support bearing 62 mounted in the pushrod support mounting bracket 60 provides a fixed pivot about which the brake pedal arm rotates to adjust from a fully forward to a fully rearward position close to the driver of the vehicle.

A significant advantage of the adjustable device of the present invention is that by selectively energizing the gearbox and drive motor assembly 38 the pivotable clevis housing 28 is oscillatable in a fore and aft position to select an optimal fore or aft position of the brake pedal arm 14 relative to the needs of the driver. Consequently, not only can the driver adjust the driver's seat to position himself or herself relative to the pedals, but the driver can also adjust the pedals themselves such that they are positioned to provide optimal comfort to the driver. The use of the invention may result in significant simplification of seat adjuster mechanisms since the function of providing adjustment of the seat to enable reaching the pedals need no longer be considered. With this invention the control pedals will be pivotably adjustable towards the seat.

In addition, where all of the automobile's control pedals, namely, the brake, clutch and accelerator pedals, are provided with the adjustment device of the present invention, each control pedal can be adjusted individually or collectively so as to provide optimal positioning of the control pedals for the particular physique of the driver. The brake, clutch, and accelerator pedals of the adjustable pedal system can be controlled by a single electronic device (not shown) which appropriately adjusts the individual control pedals according to a single command initiated by the driver. Also, as explained in the preferred embodiment, a single gearbox and electronic motor assembly 38 can be used to rotate, simultaneously, each of the brake, clutch, and accelerator pedals to be accessible to the driver. Such an electronic device can easily be mounted on the instrument panel of the automobile.

Another significant advantage of the present invention is that the metal to metal contact is assured throughout the components to provide positive actuation between the brake pedal arm and the master cylinder pushrod at all times, without the need for significant additional structure. The brake pedal arm is pivotably secured to the sleeve which through bearings is mounted to the pivot shaft such that the adjustment of the pivot shaft housing, also mounted to the pivot shaft, maintains a metal to metal contact between the brake pedal arm and the master cylinder pushrod so no external elements are needed to bias the brake pedal arm to ensure continued contact with the master cylinder pushrod. Further, there is no movement of the pushrod relative to the pushrod's corresponding master cylinder during adjustment of the control pedal since the pushrod is securely mounted in a mounting bracket with appropriate pushrod support bearings, thereby preventing the control pedal's adjustment mechanism from affecting operation of the pushrod during adjustment.

In addition, the advantage of the adjustment device can be realized with minimal additional hardware, and can be readily adapted to a conventional automobile pedal system. Accordingly, excessive space beneath the instrument panel is not required to accommodate the adjustment device, nor is there a significant penalty in terms of added weight.

Accordingly, the present invention provides an automobile control pedal adjustment system that is readily adaptable to conventional automobile control pedals for selective adjustment of the control pedals relative to the driver's seat, supplementing the adjustment capability conventionally provided with a driver's seat. The control pedal adjustment device can be actuated with the switch conveniently located on the instrument panel to position the control pedals according to the desires of the specific driver. The adjustment device can be electrically operated and can be provided with controls that are integrated with the central control module of the automobile to provide a memory capability, allowing several drivers to store a preselected control pedal position that can be recalled.

Because of the extension and retraction of the pivotable clevis housing 28 due to the linear travel of the pivot shaft 26 in the slot 32*a*, the gearbox and motor mounting plate will slightly change its angular relationship between the most forward position of the pivot shaft 26 as shown in FIG. 1, and its most rearward position, as shown in FIG. 2. The purpose of the spherical dimple is to permit this reorientation with minimum frictional consequences so as to have little or no effect on the adjustable features of the mechanism.

While the invention has been described in terms of a preferred embodiment, it is apparent that other forms could be adopted by one skilled in the art. For example, it is contemplated that the motor/gearbox /actuator assembly can be replaced with a Bowden wire cable assembly in order to allow adjustment to be made manually if desired. Accordingly, the scope of the invention is to be limited only by the following claims:

What is claimed is:

1. An automobile pedal system comprising:

a brake pedal arm having one end, an opposite end, and a pedal arm pivot axis therebetween;

a brake pedal secured to said brake pedal arm near said opposite end of said brake pedal arm;

means for pivoting said brake pedal arm, said means for pivoting attached to said one end of said brake pedal arm to pivot said brake pedal arm about said pedal arm pivot axis;

an accelerator pedal arm having one end and an opposite end;

an accelerator pedal secured to said accelerator pedal arm near said opposite end of said accelerator pedal arm; and an accelerator adjustment link having one end coextending with said one end of said brake pedal arm and further having an opposite end pivotally attached to said accelerator pedal arm at a location between said one end of said accelerator pedal arm and said opposite end of said accelerator pedal arm, whereby as said means for pivoting pivots said brake pedal arm about said pedal arm pivot axis, said accelerator adjustment link pivots said accelerator pedal arm, such that said brake pedal arm and said accelerator adjustment link pivot from a first position to a second position such that said brake pedal and said accelerator pedal move from a first adjusted position to a second adjusted position.

2. An automobile pedal system according to claim 1 wherein said means for pivoting comprises:

a generally U-shaped bracket with a spaced apart pair of legs, each of said pair of legs having a slot therein;

means traversing said U-shaped bracket and engaging said slot of each of said pair of legs of said U-shaped bracket for supporting said one end of said brake pedal arm and said accelerator adjustment link, said means for supporting being pivotable with respect to said U-shaped bracket; and drive means for oscillating said supporting means with respect to said U-shaped bracket.

3. An automobile pedal system according to claim 2 wherein said drive means comprises:

a reversible electric motor and gear assembly secured to an end of said U-shaped bracket and having an externally threaded output shaft extending therefrom, said means for supporting having an internally threaded opening for receiving said externally threaded output shaft;

whereby rotation of said externally threaded output shaft of said electric motor and gear assembly causes said means for supporting to oscillate with respect to said U-shaped bracket.

4. An automobile pedal system according to claim 1 wherein said accelerator adjustment link comprises:

an upper portion;

a lower portion; and fastening means for releasably securing said one end of said accelerator adjustment link to said means for pivoting said brake pedal arm;

said accelerator adjustment link being extensible by moving said lower portion downward relative to said upper portion when said fastening means is released to adjust the position of said accelerator pedal relative to said brake pedal.

5. An automobile pedal system comprising:

a pedal arm having one end, an opposite end terminating with a pedal attached thereto, and a pedal arm pivot axis positioned between said one end and said opposite end;

means for oscillating said pedal arm about said pedal arm pivot axis, said means for oscillating being attached to said one end of said pedal arm for displacing said one end of said pedal arm, such that as said means for oscillating moves from one end position to an opposite end position said pedal arm pivots about said pedal arm pivot axis, and said opposite end of said pedal arm adjusts from a first adjustment position to a second opposite adjustment position;

a housing having a closed end and opposing walls extending in a direction away from said closed end, each of said opposing walls having a slot therethrough, each of said opposing walls defining one end and an opposite end of each said slot respectively;

a pivot shaft having one end mounted in one of said slots of said opposing walls and an opposite end mounted in the other of said slots of said opposing walls; and means for traversing said pivot shaft within each said slot between each said one end of each said slot and each said opposite end of each said slot; and means for mounting said one end of said pedal arm to said pivot shaft whereby as said means for traversing moves said pivot shaft from said one end of said slots to said opposite end of said slots said pedal arm pivots about said pedal arm pivot axis to adjust said pedal from said first adjustment position to said second opposite adjustment position.

6. The automobile pedal system as claimed in claim 5 further comprising:

an accelerator pedal arm having one end and an opposite end;

an accelerator pedal secured to said accelerator pedal arm at said opposite end of said accelerator pedal arm;

an accelerator link having one end pivotably attached to said accelerator pedal arm between said one end and said opposite end of said accelerator pedal arm, and an opposite end having a slot therein pivotably attached to said pivot shaft for movement relative thereto;

means for mounting said accelerator link to said housing for rotation of said accelerator link relative to said housing; and means for attaching said opposite end of said accelerator link to said accelerator pedal arm and said one end of said accelerator link to said pivot shaft.

7. The automobile pedal system of claim 5 wherein said means for traversing said pivot shaft further comprises:

a clevis housing member located between said opposing walls of said housing, said clevis housing member having one end attached to said pivot shaft and an opposite end comprising a body portion, said body portion having a threaded aperture therein; and means for translating said clevis housing member from a first start of travel position to a second end of travel position, said translating means being mounted to said closed end of said housing, said translating means further comprising:

an electric motor, a gearbox integral with said electric motor; and a threaded shaft extending from said gearbox in a direction towards said body portion of said clevis housing member and engaging said threaded aperture therein such that as said electric motor is energized said gearbox is driven to turn said threaded shaft extending therefrom into said threaded aperture of said clevis housing member and cause said clevis housing member to translate along said threaded shaft to traverse said pivot shaft, such that said pedal arm pivots about said pedal arm pivot axis to adjust said pedal from said first adjustment position to said second opposite adjustment position.

8. The automobile pedal system as claim in claim 7 wherein said closed end of said housing further comprises:

a spherical projection having an aperture therein for receiving said threaded shaft extending from said gearbox; and means for mounting said threaded shaft to said spherical projection whereby as said clevis housing member translates along said threaded shaft said electric motor and said gearbox pivot about said spherical projection.

9. An automobile pedal system comprising:

a pedal arm having one end, an opposite end terminating with a pedal attached thereto, and a pedal arm pivot axis positioned between said one end and said opposite end;

means for oscillating said pedal arm about said pedal arm pivot axis, said means for oscillating being attached to said one end of said pedal arm for displacing said one end of said pedal arm such that as said means for oscillating moves from one end position to an opposite end position said pedal arm pivots about said pedal arm pivot axis, and said opposite end of said pedal arm adjusts from a first adjustment position to a second opposite adjustment position;

a reaction member;

a housing having a closed end and opposing walls extending in a direction away from said closed end;

a pivot shaft extending between said opposing walls of said housing;

a support bracket mounted between said opposing walls of said housing, said support bracket having an aperture therein and a sliding bearing mounted in said aperture adapted to receive said reaction member;

means for traversing said pivot shaft from a first beginning of travel position to a second end of travel position; and means for mounting said one end of said pedal arm to said pivot shaft whereby as said means for traversing moves said pivot shaft from said first beginning of travel position to said second end of travel position said pedal arm pivots about said pedal arm pivot axis to adjust said pedal from said first adjustment position to said second opposite adjustment position.

10. The automobile pedal system as claimed in claim 9 further comprising:

an accelerator pedal arm having one end and an opposite end;

an accelerator pedal secured to said accelerator pedal arm at said opposite end of said accelerator pedal arm;

an accelerator link having one end pivotably attached to said accelerator pedal arm between said one end and said opposite end of said accelerator pedal arm, and an opposite end having a slot therein pivotably attached to said pivot shaft for movement relative thereto;

means for mounting said accelerator link to said housing for rotation of said accelerator link relative to said housing; and means for attaching said opposite end of said accelerator link to said accelerator pedal arm and said one end of said accelerator link to said pivot shaft.

11. The automobile pedal system of claim 9 wherein said means for traversing said pivot shaft further comprises:

a clevis housing member located between said opposing walls of said housing, said clevis housing member having one end attached to said pivot shaft and an opposite end extending in a direction away from said pivot shaft, said opposite end comprising a body portion, said body portion having a threaded aperture therein; and means for translating said clevis housing member from said first beginning of travel position to said second end of travel position, said translating means being mounted to said closed end of said housing, said translating means further comprising:

an electric motor;

a gearbox integral with said electric motor; and a threaded shaft extending from said gearbox in a direction towards said body portion of said clevis housing member and engaging said threaded aperture therein such that as said electric motor is energized said gearbox is driven to turn said threaded shaft extending therefrom into said threaded aperture of said clevis housing member and cause said clevis housing member to translate along said threaded shaft to traverse said pivot shaft from said first beginning of travel position to said second end of travel position such that said pedal arm pivots about said pedal arm pivot axis to adjust said pedal from said first adjustment position to said second opposite adjustment position.

12. The automobile pedal system as claim in claim 11 wherein said closed end of said housing further comprises:

a spherical projection having an aperture therein for receiving said threaded shaft extending from said gearbox; and means for mounting said threaded shaft to said spherical projection whereby as said clevis housing member translates along said threaded shaft said electric motor and said gearbox pivot about said spherical projection.

13. A method for adjusting the positions of a brake pedal and an accelerator pedal of a pedal system for an automobile having a master cylinder pushrod with a free end and an accelerator cable, said positions of said brake pedal and said accelerator pedal being adjusted in unison, said method comprising the steps of:

providing a brake pedal arm having an uppermost end and a lowermost end, said brake pedal being secured to said brake pedal arm at a location near said lowermost end of said brake pedal arm;

pivoting said brake pedal arm about said free end of said master cylinder pushrod at a location between said uppermost end of said brake pedal arm and said lowermost end of said brake pedal arm, said step of pivoting said brake pedal arm being performed by imposing an oscillating force on said brake pedal arm at a location near said uppermost end of said brake pedal arm;

providing an accelerator pedal arm, said accelerator pedal being secured to a lowermost end of said accelerator pedal arm, an uppermost end of said accelerator pedal arm engaging said accelerator cable; and providing an accelerator pedal adjustment link having an uppermost end coextensive with said uppermost end of said brake pedal arm and a lowermost end pivotally secured to said accelerator pedal arm at a location between said uppermost end of said accelerator pedal arm and said lowermost end of said accelerator pedal arm.

14. The method of claim 13 wherein the step of imposing an oscillating force on said brake pedal arm is performed by a reversible electric motor and gearbox assembly, a rotation of an output shaft of said reversible electric motor and gearbox assembly acting to advance or retract a pivot shaft about which said brake pedal arm is pivotally attached and about which said accelerator pedal adjustment link is pivotally attached.

* * * * *

UNITED STATES PATENT AND TRADEMARK OFFICE

CERTIFICATE OF CORRECTION

PATENT NO. : 6,324,939 B1
DATED : December 4, 2001
INVENTOR(S) : Cicotte

It is certified that error appears in the above-identified patent and that said Letters Patent is hereby corrected as shown below:

Column 3,
Line 18, delete “U.s.” and insert -- U.S. --.

Column 5,
Line 58, delete “direct” and insert -- direction --.

Column 12,
Line 41, delete first occurrence “claim” and insert -- claimed --.

Column 14,
Line 9, delete first occurrence “claim” and insert -- claimed --.

Signed and Sealed this

Nineteenth Day of November, 2002

*Attest:*

*Attesting Officer*

JAMES E. ROGAN
*Director of the United States Patent and Trademark Office*